US005222282A

United States Patent [19]

Sukonnik et al.

[11] Patent Number: 5,222,282

[45] Date of Patent: Jun. 29, 1993

[54] METHOD FOR REDUCING THICKNESS OF A HIGH-STRENGTH LOW-DUCTILITY METAL FOIL ON THIN STRIP ELEMENT

[75] Inventors: Israil Sukonnik, Plainville, Mass.; Jack D. Brownlee, Woonsocket, R.I.

[73] Assignee: Texas Instruments Incorporated, Dallas, Tex.

[21] Appl. No.: 819,695

[22] Filed: Jan. 13, 1992

[51] Int. Cl.[5] ..... B21D 33/00

[52] U.S. Cl. ..... 29/17.9; 29/17.1; 29/17.5; 29/423

[58] Field of Search ..... 29/423, 424, 17.2, 17.5, 29/17.9; 72/184

[56] References Cited

U.S. PATENT DOCUMENTS

| | | | |
|---|---|---|---|
| 3,152,383 | 10/1964 | Steigerwalt | 29/17.5 |
| 3,938,723 | 2/1976 | Slaughter | 29/423 X |
| 4,831,708 | 5/1989 | Yoshiwara et al. | 29/423 |

*Primary Examiner*—Joseph M. Gorski

*Attorney, Agent, or Firm*—Russell E. Baumann; Richard L. Donaldson; René E. Grossman

[57] ABSTRACT

A thin strip or foil element of titanium aluminide, nickel aluminide or high strength titanium alloy material is inserted between a metal carrier strip and a metal top lid strip having one end welded or otherwise secured to the carrier strip to be passed between pressure rolls of a rolling mill with the strips and squeezed together with the strips in air at room temperature a plurality of times, preferably with a metal pressure board disposed against the top lid strip adjacent the top pressure roll, to reduce the thickness of the thin strip or foil element by at least 15 percent each time. The element is heated in a protective atmosphere after each reduction in thickness to stress relieve and at least partially recrystallize the element material.

14 Claims, 2 Drawing Sheets

METHOD FOR REDUCING THICKNESS OF A HIGH-STRENGTH LOW-DUCTILITY METAL FOIL ON THIN STRIP ELEMENT

BACKGROUND OF THE INVENTION

The field of the invention is that of high-strength, low-ductility metal materials, and the invention relates more particularly to methods for making thin foils of such materials.

The use of thin foils of materials such as titanium aluminides and high strength titanium alloys is commonly proposed for building up fiber-reinforced sheet materials and honeycomb structural elements and the like for application in the aircraft industry and elsewhere where high strength-to-weight components are required. However, titanium materials of that character are difficult to process into foil and thin strip elements. Typically, for example, titanium aluminides and high strength titanium alloys are hot roll forged and are then hot rolled repeatedly in a protective atmosphere to progressively reduce the thickness of the titanium materials. As the material thickness is reduced to the level of thin strips or foils, the amount of thickness reduction which can be achieved with each hot rolling thickness reduction pass grows smaller. Such thin strip or foil materials are thus far made for that proposed purpose only by a cumbersome, low-yield process which combines hot pack rolling with chemical milling or abrading. In that known process, sheets of a selected titanium aluminide or high strength titanium alloy are arranged in a stack inside a metal package with a stop-weld or separator material such as lime disposed between the sheets. The metal is alternately rolled at elevated temperature in a conventional rolling mill and heat-treated for annealing the metal package and titanium materials to gradually reduce the thicknesses of the sheets in the stack toward dimensions. The metal package is then removed and the sheets in the stack are separated from each other. After pickling for removal of the separator material the sheets are then chemically milled or abraded to provide the sheets with desired finish and final foil dimensions, a final step which typically reduces yield of the process well below fifty percent. It would be desirable if novel and improved methods could be devised for reducing foils of titanium aluminide and high strength titanium alloys and similar materials free of edge cracking in the foils in a more economical manner.

BRIEF SUMMARY OF THE INVENTION

It is an object of the invention to provide novel and improved methods for making titanium foil and thin strip materials; to provide such methods which are particularly adapted for making thin strips and foils of titanium aluminides, nickel aluminides, metal beryllides and high strength titanium alloys; to provide such methods for producing such strip and foil materials substantially free of edge cracking in the strips and foils; to provide such methods for making such thin strips and foils in an economical manner; and to provide such methods which are versatile for producing thin strips and foils from various titanium aluminide, nickel aluminide, metal beryllide and high strength titanium alloy materials.

Briefly described, the novel and improved method of the invention comprises the steps of providing a thin strip or foil element of a titanium aluminide, nickel aluminide, metal beryllide, or high strength titanium alloy material having a desired initial length, width and thickness. Typically, for example, the element comprises a sheet of titanium material selected from the group consisting of alpha/alpha-2 titanium aluminides such as an intermetallic compound having a composition by weight percent of 8.5 percent aluminum, 5 percent niobium, 1 percent molybdenum, 1 percent zirconium, 1 percent vanadium and the balance titanium (Ti8.5Al5Nb1Mo1Zr1V), alpha-2 titanium aluminides such as an intermetallic compound having a composition by weight percent of 14 percent aluminum, 21 percent niobium and the balance titanium (Ti14Al21Nb), super alpha-2 titanium aluminides such as an intermetallic compound having a composition by weight percent of 14 percent aluminum, 20 percent niobium, 3.2 percent molybdenum, 2 percent vanadium and the balance titanium (Ti14Al20Nb3.2Mo2V) and such as an orthorhombic intermetallic compound having a composition by weight percent of 11 percent aluminum, 38 percent niobium, 3.8 percent vanadium and the balance titanium (Ti11Al38Nb3.8V), near alpha aluminide titanium alloys such as a high strength titanium alloy having a composition by weight percent of 6 percent aluminum, 3 percent tin, 4 percent zirconium and the balance titanium (Ti6Al3Sn4Zr or Ti1100), alpha/beta aluminide titanium alloys such as a high strength titanium alloy having a composition by weight percent of 6 percent aluminum, 4 percent vanadium and the balance titanium (Ti6Al4V or Ti64), and beta aluminide titanium alloys such as a high strength titanium alloy having a composition by weight percent of 3 percent aluminum, 3 percent niobium, 15 percent molybdenum and the balance titanium (Ti3Al3Nb15Mo or Beta 21S).

These titanium aluminides and alloys further include intermetallic compounds or alloys having compositions by weight of 24 percent aluminum, 11 percent niobium and the balance titanium, having a composition by weight of 25 percent aluminum, 10 percent niobium, 3 percent vanadium, 1 percent molybdenum and the balance titanium, having a composition by weight of 6 percent aluminum, 2 percent tin, 4 percent zirconium, 2 percent molybdenum and the balance titanium, and having a composition by weight of 22 percent aluminum, 28 percent niobium and the balance titanium. The element preferably has a starting thickness in the range from about 0.040 to 0.020 inches as formed by conventional hot rolled forging and progressive hot rolling thickness reductions in such materials . If desired, a plurality of sheets of element material as provided by the conventional hot rolling processes are secured together by welding or the like to provide a starting element of substantial length.

In the method of the invention, a metal carrier strip is fed from a pay-off reel between pressure rolls of a conventional rolling mill to a take-up reel and a top lid metal strip has one end secured to the carrier strip to be pulled between the pressure rolls with the carrier strip. The starting element of high-strength, low-ductility material is inserted between the top lid strip and the carrier strip to be advanced between the pressure rolls with the strips. The top lid strip, element and carrier strip are pressed together between the rolls in air at room temperature, preferably a plurality of times and preferably free of any lubricant or stop-weld material between the strips and element for reducing the thickness of the element. Preferably a pressure board of metal, wood or hard plastic material is arranged to press against the top lid strip adjacent the top pressure roll of the mill to facilitate the element thickness reduction. Preferably also the element thickness is reduced by a substantial amount, preferably by at least 15 percent, each time the element is passed between the pressure rolls. Preferably the element material is heated in a protective atmosphere to stress relieve and at least partially recrystallize the element material after each reduction in element thickness.

In a preferred embodiment where the element material comprises an exemplary material as noted above, the carrier strip and the top lid strip preferably embody an austenitic stainless steel material in partially work-hardened condition, and the pressure board, strips and element are squeezed together with sufficient pressure to reduce element thickness by at least 15 percent each time while avoiding bonding of the thin strip or foil element to the thin strip materials. Preferably the carrier strip is subjected to substantial tension force as it is advanced between the pressure rolls. Preferably the carrier strip is coiled on the take-up reel during each reduction in thickness. Preferably the element material is arranged in coil form interleaved with iron aluminide separator material during heating in a vacuum or a protective atmosphere of argon or the like to stress relieve and at least partially recrystallize the element material after element thickness reduction.

In that way, the high-strength, low-ductility thin strip or foil materials are substantially reduced in thickness during each rolling thickness reduction pass substantially free of cracking along edges of the thin strip or foil element. The element foil is also provided with substantial flatness and excellent surface finish and texture.

DESCRIPTION OF THE DRAWINGS

Other objects, advantages and details of the novel and improved methods of the invention appear in the following detailed of preferred embodiments of the invention, the detailed description referring to the drawings in which.

DESCRIPTION OF THE PREFERRED EMBODIMENTS

Figure 1:
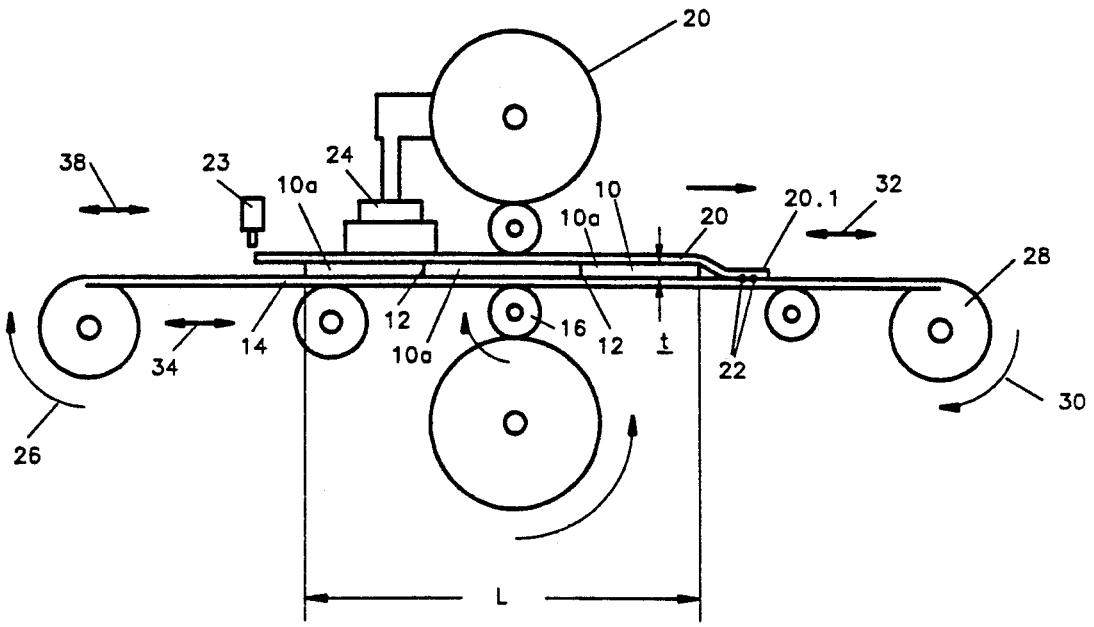
FIG. 1 is a diagrammatic side elevation view illustrating a step in the process of the invention.
Figure 2:
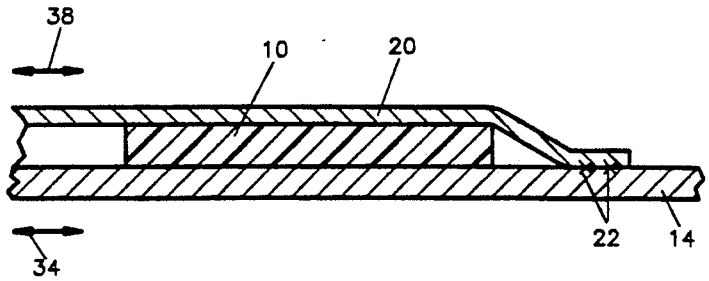
FIG. 2 is a section view to enlarged scale along a longitudinal axis of the element being processed in FIG. 1.
Figure 3:
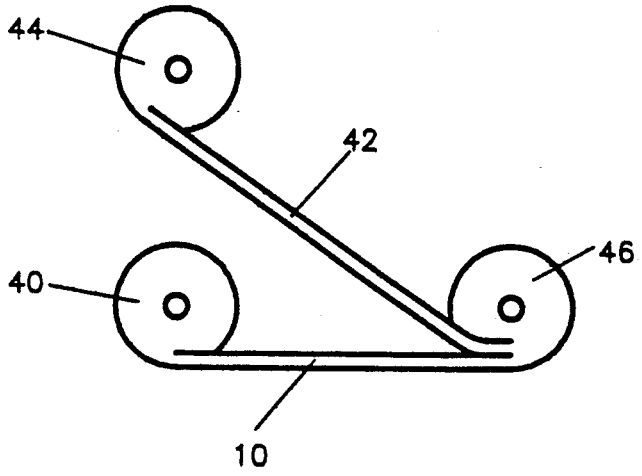
FIG. 3 is a diagrammatic side elevation view illustrating another subsequent step in the process of the invention.
Figure 4:
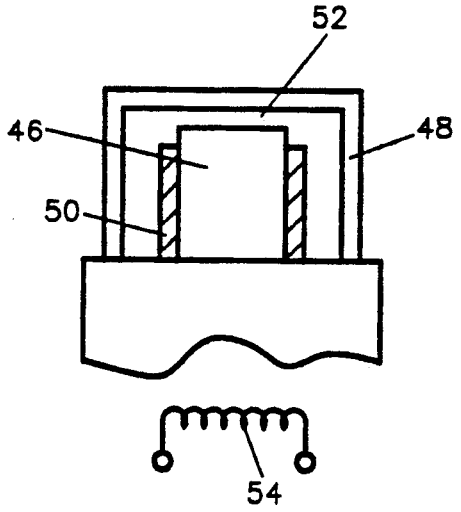
FIG. 4 is a diagrammatic side elevation view illustrating an additional subsequent step in the method of the invention.

Referring to the drawings, 10 in FIGS. 1–3 indicates a titanium or beryllium foil or thin strip element having a selected length 1, a selected width extending into the plane viewed in FIG. 1, and a selected thickness t which is provided as the starting material for the process of the invention, the element preferably comprising a titanium aluminide, nickel aluminide high strength titanium alloy material or high strength metal beryllide material such as might be useful for reduction to selected, lesser foil or strip element thickness for use in building up fiber-reinforced sheet materials and honeycomb structural elements and the like for the aircraft industry. Preferably, for example, the starting element 10 embodies a titanium aluminide or high-strength titanium alloy selected from the group consisting of alpha/alpha-2 titanium aluminides such as an intermetallic compound having a composition by weight percent of 8.5 percent aluminum, 5 percent niobium, 1 percent molybdenum, 1 percent zirconium, 1 percent vanadium and the balance titanium (Ti8.5Al5Nb1Mo1Zr1V), alpha-2 titanium aluminides such as an intermetallic compound having a composition by weight percent of 14 percent aluminum, 21 percent niobium and the balance titanium (Ti14Al21Nb), super alpha-2 titanium aluminides such as an intermetallic compound having a composition by weight percent of 14 percent aluminum, 20 percent niobium, 3.2 percent molybdenum, 2 percent vanadium and the balance titanium (Ti14Al20Nb3.2Mo2V) and such as an orthorhombic intermetallic compound having a composition by weight percent of 11 percent aluminum, 38 percent niobium, 3.8 percent vanadium and the balance titanium (Ti11Al38Nb3.8V), near alpha aluminide titanium alloys such as a high strength titanium alloy having a composition by weight percent of 6 percent aluminum, 3 percent tin, 4 percent zirconium and the balance titanium (Ti6Al3Sn4Zr or Ti1100), alpha/beta aluminide titanium alloys such as a high strength titanium alloy having a composition by weight percent of 6 percent aluminum, 4 percent vanadium and the balance titanium (Ti6Al4V or Ti64), and beta aluminide titanium alloys such as a high strength titanium alloy having a composition by weight percent of 3 percent aluminum, 3 percent niobium, 15 percent molybdenum and the balance titanium (Ti3Al3Nb15Mo or Beta 21S).

These titanium aluminides and alloys further include intermetallic compounds or alloys having compositions by weight of 24 percent aluminum, 11 percent niobium and the balance titanium, having a composition by weight of 25 percent aluminum, 10 percent niobium, 3 percent vanadium, 1 percent molybdenum and the balance titanium, having a composition by weight of 6 percent aluminum, 2 percent tin, 4 percent zirconium, 2 percent molybdenum and the balance titanium, and having a composition by weight of 22 percent aluminum, 28 percent niobium and the balance titanium.

Such starting element materials are commercially available and are commonly produced by hot roll forging from a cast ingot and by hot rolling reduction of the ingot down to sheet or strip sizes on the order of 3 by 8 feet having a thickness on the order of 0.040 to 0.020 inches. Typically the sheet or strip elements are commercially available in fully annealed condition and for the purposes of this invention are slit to a desired lesser width for subsequent processing in accordance with the invention. If desired, two or more strips **10*a* cut from the commercially available sheets are secured together end-to-end in sequence by cold butt welding or resistance welding or the like as is diagrammatically indicated at 12 in FIG. 1** to provide the starting element with a desired initial length l such as 2 to 24 feet or the like.

In accordance with the invention, a metal carrier strip 14 is arranged to pass between a pair of pressure rolls 16 of a conventional rolling mill 18 and a top lid metal strip 20 is secured at one end 20.1 to the carrier strip so that the top lid strip extends along the length of the carrier strip as indicated in FIGS. 1–2. The top lid strip is secured to the carrier strip by any conventional welding, brazing, riveting or adhesive means or the like as indicated at 22 in the FIGS. 1-2, a welder 23 preferably being located for that purpose as indicated in FIG. 1. The high-strength, low-ductility element 10 is inserted between the top lid and carrier strips to be advanced between the pressure roll 16 with the strips 14 and 20. Preferably a pressure board 24 of metal, wood or hard plastic or the like is arranged over the top lid strip 20 to be pressed against the top lid strip just as the top lid strip is passed between the pressure rolls with the carrier strip and element. The pressure rolls squeeze or compress the two opposite surfaces 10.1, 10.2 of the high-strength element in air at room temperature through the top lid and carrier strips to reduce the thickness of the element at a location between the rolls and to produce an increase in element length and a concomitant increase in the area of the element surfaces. Preferably the top lid and carrier strips are relatively wider than the element 10 to overlap lateral edges of the element as it is passed between the pressure rolls to be reduced in thickness progressively along the length of the element.

Preferably opposite ends of the carrier strip is coiled around a conventional, rotably-driven pay-off reel 26 and a corresponding take-up reel 28 respectively. The take-up reel is rotated as indicated by the arrow 30 to advance the carrier strip material toward the take-up reel with substantial forward tension as is diagrammatically indicated by the arrow 32 in FIG. 1 while the pay-off reel is rotated, usually at a relatively lower rate, to provide substantial back tension in the carrier strip as indicated by the arrow 34. The top-lid strip is pulled between the pressure rolls with the carrier strip. Preferably the top lid and carrier strips are formed of a relatively high strength metal material such as stainless steel which has a yield strength somewhat less than that of the element material 10 and which has substantially greater ductility than the element so that the carrier and top lid strips 14 and 20 are also reduced in thickness and increased in length as the pressure board, strips and element are subjected to compressive force in being passed between the pressure rolls. Where the element 10 comprises a titanium aluminide, nickel aluminide, metal beryllide or high-strength titanium alloy as in the exemplary materials noted above, the carrier and top lid strips 14 and 20 are preferably formed of a 300 Series Stainless Steel or the like which is initially provided in partial work-hardened condition.

Preferably the compressive force applied to the opposite surfaces 10.1, 10.2 of the element by the rolls 16 through the top lid and carrier strips is regulated relative to the tension forces applied to the carrier and top lid strips so that the reduction in thickness of the element and of the top lid and carrier strips is proportional to obtain substantial reduction in thickness of the element in the range from at least about 15 percent to about 50 percent while substantially avoiding bonding of the element to the top lid and carrier strip materials. Preferably, for example, the carrier strip material is subjected to tension forces comprising from about 10 percent to 30 percent of the yield strength of the carrier strip material while the pressure rolls apply sufficient additional force to effect element thickness reduction in the noted range. That is, for the exemplary element noted above, the carrier strips are subjected to forward tension forces in the range from 10 percent to 30 percent of their yield strength and to back tension forces in the range from 10 percent to 30 percent of yield strength while compression forces in the range from 20,000 lbs. to 100,000 lbs. are applied via the pressure rolls.

Preferably the pressure board is utilized to cooperate with the top lid and carrier strips to simultaneously apply compressive forces to the element 10 outside the location of the pressure rolls 16 to prevent stresses established in the element by its reduction in thickness and increase in surface area from bending the element material to cause fractures in the element material along lateral edges of the element. Preferably the top lid strength and the element are coiled on the take-up reel 28 as the strips and elements are reduced in thickness in passing between the pressure rolls.

After the element 10 has been passed between the pressure rolls 16 to be substantially reduced in thickness at room temperature, the element is removed from between the top lid and carrier strips and is preferably coiled on a support reel 40 as shown in FIG. 3. A corresponding coil of iron aluminide strip material 42 is also provided on a corresponding support reel 44. The coils of the element 10 and of the iron aluminide material 42 are then transferred to a common support reel 46 and are interleaved with each other as shown in FIG. 3, the coil on the common support reel 46 being loosely wound so that convolutions of the element material are separated from each other by the strip of iron aluminide separator material. The interleaved coil of element and separator material on the common support reel 46 is then disposed within a conventional annealing oven 48 or the like, preferably supported within a metal support sleeve 50 closely fitted around the materials on the reel, and are heated in a protective atmosphere 52 as indicated at 54 in FIG. 3 to stress relieve and at least partially recrystallize the titanium element 10 on the reel 46. Preferably where the element 10 comprises the exemplary titanium aluminide, nickel aluminide, high strength metal beryllide or high strength titanium alloy materials as above described, the element material is heated to a temperature in the range from 1400° F. to 1850° F. for a period of 1 minute to 1 hour to stress relieve and at least partially recrystallize the element materials. Preferably the element material is heated in a vacuum or in an inert gas such as argon as the protective atmosphere 52.

After the material of the element 10 is stress relieved and partially recrystallized as described, the element material is cooled at room temperature and is preferably inserted between new top lid and carrier strips and the process described above is then repeated for again reducing the thickness of the element at room temperature by a reduction preferably comprising at least about 15 percent of the element thickness. The element is then again removed from between the top lid and carrier strips and is again heat-treated for stress relieving and partially recrystallizing the element material. Preferably each of the described method steps is repeated a plurality of times for progressively reducing the element thickness to a predetermined typically very small element thickness. Preferably the noted method steps are performed one additional time with a relatively small reduction in element thickness in the range from one to two percent for providing the element material with improved flatness.

EXAMPLE A

In one exemplary embodiment of the invention, a starting element 10 formed of Ti24Al11Nb material in annealed condition having a length of 24.0 inches, a width of 8.0 inches and a thickness of 0.025 inches is inserted between a carrier strip and a top lid strip of substantial length formed of 301 Stainless Steel in 10 percent work-hardened condition which is resistance welded at one to the carrier strip, the top lid and carrier strips each having a width of 8.5 inches and a thickness of 0.025 inches. The opposite ends of the carrier strip are mounted on a pay-off reel and a take-up reel respectively and the carrier strip is advanced between a pair of pressure rolls of a conventional four-high rolling mill with a forward tension of 30 percent and a back tension of 30 percent of yield strength of the carrier strip to pull the top lid strip between the rolls. A pressure board is arranged to bear against the top lid strip just as it is passed between the pressure rolls with the titanium element, and sufficient compressive force is applied to two opposite broad flat surfaces of the element through the top lid and carrier strips by the pressure rolls in air at room temperature to reduce element thickness by 25 percent progressively along the length of the element without bonding the element to the strips. The top lid and carrier strips are also reduced in thickness and the pressure board cooperates with the top lid and carrier strips to simultaneously apply compressive forces to the element outside the pressure roll location to prevent edge cracking in the element during the thickness reduction in the element. The element is then removed from between the top lid and carrier strips, is interleaved with a strip of iron aluminide material of comparable thickness in a loose coil and is heated to a temperature of 1825° F. for 1 hour in an argon atmosphere to stress relieve and at least partially recrystallize the element material. The element is then cooled to room temperature and is inserted between top lid and new carrier strip as above described and is again reduced in thickness and heat-treated as above-described. After repeating the described sequence of steps additional times, the element is reduced to a thin foil thickness of 0.004 inches and is found to be smooth finished and substantially free of edge cracking along edges of the element.

EXAMPLE B

In another exemplary embodiment of the invention, the titanium element prepared in accordance with Example A was processed through the described sequence of steps an additional time with a thickness reduction in the element in the range from one to two percent and was found to display improved flatness.

EXAMPLE C

In another exemplary embodiment of the invention, a starting element formed of Ti25Al10Ni3V1Mo material having a length of 24.0 inches, a width of 8.0 inches and a thickness of 0.020 inches in annealed condition is processed as described with reference to Example A to be reduced in thickness by 25 percent, the carrier strip being subjected to a forward tension of 25 percent of its yield strength and a back tension of 25 percent of its yield strength. The pressure board is arranged to bear against the top lid. After reduction in thickness, the element is removed from between the top lid and carrier strips, is interleaved in a loose coil with an iron aluminide separator, is fitted within a metal support sleeve, and is heated to a temperature of 1750° F. for 1 hour in a vacuum to stress relieve and partially recrystallize the element material. After repeating the above-described steps additional times, the element is reduced to a thickness of 0.0044 inches and is found to have a smooth surface finish and uniform thickness along its length and to be substantially free of edge cracks.

EXAMPLES D, E AND F

In other exemplary embodiments of the invention, starting element of Ti6Al4V material, of Ti6Al2Sn4Zr-2Mo material, and of Ti22Al28Nb material respectively each having a length of 24.0 inches, a width of 8.0 inches and a thickness of 0.025 inches are inserted between a top lid strip and a carrier strip formed of 301 Stainless Steel as described in Example A to be passed between a pair of pressure rolls with the top lid and carrier strips and with a pressure board of dimensions as described in Example A. The carrier strip is subjected to forward tension 15 percent, 20 percent and 40 percent and to back tensions of 20 percent, 25 percent and 45 percent (of their yield strengths) respectively. Sufficient compressive force is applied to the element in air at room temperature to reduce element thickness by 50 percent, 40 percent and 20 percent respectively. The elements are removed from between the top lid and carrier strips and are heat-treated as described in Example A at temperatures of 1400° F., 1850° F. and 1825° F. for one, one and one hour respectively in an argon atmosphere. After repeating the above-described steps additional times, the elements are reduced to respective uniform thicknesses of 0.004 inches, 0.004 inches and 0.005 inches respectively, have smooth surface finishes, and are substantially free of edge cracking.

EXAMPLES G, H, AND J

In other exemplary embodiments of the invention, starting elements of alpha/alpha-2 titanium aluminide, alpha-2 titanium aluminide, and super alpha-2 titanium aluminide, respectively, each having a length of 24.0 inches, a width 8.0 inches and a thickness of 0.05 inches are inserted between a top lid strip and a carrier strip formed of 301 Stainless Steel as described in Example A to be passed between a pair of pressure rolls with the top lid and carrier strips while having a pressure board arranged as described in Example A. The carrier strips are subjected to forward tensions of 30 percent, 30 percent and 30 percent and to back tensions of 30 percent, 30 percent and 30 percent (of their yield strengths) respectively. Sufficient compressive force is applied to the elements in air at room temperature to reduce element thickness by 35 percent, 25 percent and 25 percent respectively. The elements are removed from between the top lid and carrier strips and are heat-treated as described in Example A at temperatures of 1825° F., 1825° F. and 1750° for one, one and one hour respectively in an argon atmosphere. After repeating the above-described steps 4, 5 and 5 times respectively, the elements are reduced to respective uniform thicknesses of 0.0044, 0.0044 and 0.0044 inches respectively, have smooth surface finishes, and are substantially free of edge cracking.

In that way, the thin strip or foil elements of titanium aluminide, nickel aluminide, high strength beryllide, and high strength titanium alloy materials are produced with good foil characteristics in an economically and commercially feasible manner. If desired, narrow edge trimming is carried out in conventional manner to straighten foil edges. The method of the invention provides foil materials suitable for use in building up fiber-reinforced materials and honeycomb structures for the aircraft industry.

It should be understood that although particular embodiments of the method of the invention have been described by way of illustrating the invention, the invention includes all modifications and equivalents of the disclosed embodiment falling within the scope of the appended claims.

We claim:

1. A method for processing a thin strip material of high strength, low ductility metal, comprising the step of: advancing a carrier metal strip between pressure rolls under tension; securing one end of a top lid metal strip to the carrier strip to be advanced between the pressure rolls with the carrier strip; inserting a single thin strip material of high-strength, low-ductility metal having a selected length and width and relatively smaller thickness between the top lid strip and the carrier strip to be carried between the pressure rolls with the strips; squeezing the top lid and carrier strips between the pressure rolls at room temperature by passing the strips between the rolls while maintaining the carrier metal strip under tension, thereby reducing the thickness of the thin strip material progressively along its length, and separating the material from the strips.

2. The method according to claim 1 wherein the thin strip material embodies a metal material selected from the group consisting of alpha/alpha-2 titanium aluminide intermetallic compounds, alpha-2 titanium aluminide intermetallic compounds, super alpha-2 titanium aluminide intermetallic compounds, nickel aluminides, metal beryllides, near alpha titanium aluminide high strength titanium alloys, alpha/beta aluminide high strength titanium alloys, and beta aluminide high strength titanium alloys.

3. The method according to claim 2 wherein the thin strip material is selected from the group consisting of alpha/alpha-2 titanium aluminide intermetallic compounds having a composition by weight percent of 8.5 percent aluminum, 5 percent niobium, 1 percent molybdenum, 1 percent zirconium, 1 percent vanadium and the balance titanium, alpha-2 titanium aluminide intermetallic compound having a composition by weight percent of 14 percent aluminum, 21 percent niobium and the balance titanium, super alpha-2 titanium aluminide intermetallic compound having a composition by weight percent of 14 percent aluminum, 20 percent niobium, 3.2 percent molybdenum, 2 percent vanadium and the balance titanium, orthorhombic super alpha-2 titanium aluminide intermetallic compound having a composition by weight percent of 11 percent aluminum, 38 percent niobium, 3.8 percent vanadium and the balance titanium, near alpha aluminide high strength titanium alloy having a composition by weight percent of 6 percent aluminum, 3 percent tin, 4 percent zirconium and the balance titanium, alpha/beta aluminide high strength titanium alloy having a composition by weight percent of 6 percent aluminum, 4 percent vanadium and the balance titanium, and beta aluminide high strength titanium alloy having a composition by weight percent of 3 percent aluminum, 3 percent niobium, 15 percent molybdenum and the balance titanium.

4. The method according to claim 3 including heating the thin strip material in a protective atmosphere thereby relieving stress and at least partially recrystallizing the material.

5. A method for processing a thin strip element of high-strength, low-ductility metal, comprising the steps of: advancing a carrier metal strip from a pay-off reel between pressure rolls to a take-up reel under tension between both the pay-off reel and the pressure rolls and the pressure rolls and the take-up reel; securing one end of a top lid metal strip to the carrier strip to be pulled between the pressure rolls with the carrier strip; inserting one thin strip element of high-strength, low-ductility metal material having a select length and width and relatively smaller thickness between the top lid and carrier strips to be carried between the pressure rolls with the carrier strip and covered by the top lid strip; pressing a pressure board against the top lid strip adjacent to the pressure rolls; squeezing the top lid strip, element and carrier strip together between the pressure rolls in air at room temperature while maintaining the carrier metal strip under tension, thereby prohibiting wrinkling and maintaining alignment of said element as the strips and element are passed between the rolls while reducing the thickness of the element progressively along the element length; and separating the element from the strips.

6. The method according to claim 5 including passing the element between the pressure rolls a plurality of times thereby reducing the thickness each time, and heating the element in a protective atmosphere each time, thereby relieving stress and at least partially recrystallizing the element material after each reduction in element thickness.

7. The method according to claim 6 wherein the element material is selected from the group consisting of alpha/alpha-2 titanium aluminide intermetallic compound having a composition by weight percent of 8.5 percent aluminum, 5 percent niobium, 1 percent molybdenum, 1 percent zirconium, 1 percent vanadium and the balance titanium, alpha-2 titanium aluminide intermetallic compound having a composition by weight percent of 14 percent aluminum, 21 percent niobium and the balance titanium, super alpha-2 titanium aluminide intermetallic compound having a composition by weight percent of 14 percent aluminum 20 percent niobium, 3.2 percent molybdenum, 2 percent vanadium and the balance titanium, orthorhombic super alpha-2 titanium aluminide intermetallic compound having a composition by weight percent of 11 percent aluminum, 38 percent niobium, 3.8 percent vanadium and the balance titanium, near alpha aluminide high strength titanium alloy having a composition by weight percent of 6 percent aluminum, 3 percent tin, 4 percent zirconium and the balance titanium, alpha/beta aluminide high strength titanium alloy having a composition by weight percent of 6 percent aluminum, 4 percent vanadium and the balance titanium, and beta aluminide high strength titanium alloy having a composition by weight percent of 3 percent aluminum, 3 percent niobium, 15 percent molybdenum and the balance titanium.

8. The method according to claim 7 wherein the top lid and carries strips embody austenitic stainless steel materials.

9. A method according to claim 8 wherein the pressure board embodies a high-strength, low-ductility metal of relatively much greater thickness than the element.

10. The method according to claim 9 wherein the top lid and carrier strips comprise 301 Stainless Steel in 10 percent work-hardened condition, and wherein said squeezing includes squeezing said strips and element together with sufficient pressure such that element thickness is reduced by at least 15 percent each time while avoiding bonding of the strip material to the element.

11. The method according to claim 9 including coiling the top lid strip and element on the take-up reel after each reduction in element thickness.

12. The method according to claim 11 including inserting a plurality of elements in sequence between the top lid and carrier strips.

13. The method according to claim 12 including coiling the top lid strip and element on the take-up reel after each reduction in element thickness.

14. The method according to claim 6 including arranging the element in coil form and interleaving the coil with an iron aluminide material and then heating the coil, thereby relieving stress and at least partially recrystallizing the element material.

* * * * *